US011293596B1

(12) United States Patent
Wang

(10) Patent No.: US 11,293,596 B1
(45) Date of Patent: Apr. 5, 2022

(54) WATERPROOF BULB STRUCTURE

(71) Applicant: DONGGUAN HUIHUAN LIGHTING CO., LTD., Dongguan (CN)

(72) Inventor: Song Wang, Chengdu (CN)

(73) Assignee: DONGGUAN HUIHUAN LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/244,932

(22) Filed: Apr. 29, 2021

(30) Foreign Application Priority Data

Dec. 25, 2020 (CN) ..... 202023186343.1
Apr. 1, 2021 (CN) ..... 202120671528.7

(51) Int. Cl.
*F21K 9/23* (2016.01)
*F21V 31/00* (2006.01)
*F21Y 115/10* (2016.01)

(52) U.S. Cl.
CPC ..... *F21K 9/23* (2016.08); *F21V 31/005* (2013.01); *F21Y 2115/10* (2016.08)

(58) Field of Classification Search
CPC ..... F21V 31/005; F21K 9/23; F21K 9/237; F21K 9/238
See application file for complete search history.

(56) References Cited

U.S. PATENT DOCUMENTS 10,066,824 B2 * 9/2018 Wu ..... F21K 9/238
10,094,550 B2 * 10/2018 Chen ..... F21K 9/238
10,718,470 B1 * 7/2020 Wu ..... F21K 9/235
10,890,299 B2 * 1/2021 Ye ..... F21K 9/232
2012/0217862 A1 * 8/2012 Matsuda ..... F21K 9/232 313/46
2017/0292692 A1 * 10/2017 Chen ..... F21V 31/00

* cited by examiner

*Primary Examiner* — Arman B Fallahkhair

(57) ABSTRACT

The present invention relates to the technical field of bulbs, and discloses a waterproof bulb structure comprising a bulb shell, a lamp holder connected with the bulb shell, and further comprising a core column assembly and a rubber seal seat with an elastic waterproof seal; the core column assembly comprises a first conductive component, an LED light bar and a second conductive component that are electrically connected in sequence. The present invention has the following advantages: resistors are fixed at the rubber seal seat, with wires passing through sealing holes, and the first conductive component and the second conductive component are in fit with the sealing holes to prevent water or moisture from entering the bulb shell, so that water can be completely prevented from entering the bulb shell, and the lamp does not produce fogging when in use, and has good lighting effect and longer service life.

7 Claims, 5 Drawing Sheets

WATERPROOF BULB STRUCTURE

TECHNICAL FIELD

The present invention relates to the technical field of bulbs, in particular to a waterproof bulb structure.

BACKGROUND

Bulbs are the main lamps used for lighting. With the development of technology, a variety of bulbs have become common from conventional tungsten bulbs to the current LED chip bulbs and LED strip bulbs.

The existing LED bulbs, especially bulb structures with LED light bars, often have the problem of water in bulb shells due to climate, environment, rain and the like in actual use, so that the LED light bars are damaged or the water vapor produces fogging in the bulb shells, affecting the use. How to prevent water from entering the bulb shells is the key to the problem.

A Chinese patent discloses an LED waterproof lamp bulb, comprising a lamp holder, a lamp base, a lamp body, a light source component and a light transmission cover, wherein a driving device is also arranged in a cavity formed by the lamp base and the lamp body; the lamp body comprises a hollow base and a radiator; the radiator is provided with the light source component and a reflector; and a sealing element made up of a sealing ring or a rubber ring is arranged between the light transmission cover and the hollow base. In fact, such sealing and waterproof way has extremely complex structure, poor applicability, and high cost. Therefore, the inventor made an invention.

SUMMARY

In order to solve defects in the prior art, the purpose of the present invention is to provide a waterproof bulb structure having the advantages of good water resistance and easy automatic assembly.

In order to achieve the purpose, the present invention provides a waterproof bulb structure comprising a bulb shell, a lamp holder connected with the bulb shell, and further comprising a core column assembly and a rubbery seal seat with an elastic waterproof seal; the core column assembly comprises a first conductive component, an LED light bar and a second conductive component that are electrically connected in sequence;

wherein the first conductive component comprises a first resistor, and both ends of the first resistor are connected with a first extension wire;

both ends of the second conductive component are connected with a second extension wire;

the rubbery seal seat is provided with at least two sealing holes for accommodating the first conductive component and the second conductive component, and any first extension wire or the second extension wire pass through the sealing holes respectively; wherein an extension wire a is electrically connected to one electrode of the lamp holder as an input terminal, and the second extension wire is electrically connected to the other electrode of the lamp holder as an output terminal;

the rubbery seal seat is in close fit with the inner side of a mouth of the bulb shell, and the lamp holder is fixedly connected with the outer side of the mouth of the bulb shell.

As an embodiment, open ends of the sealing holes are arranged at the inner side of the mouth of the bulb shell, and the bottom of the sealing holes is arranged at the outer side of the mouth of the bulb shell, so that the technical effect of sealing and waterproofing can be achieved.

As another embodiment, the open ends of the sealing holes are arranged at the outer side of the mouth of the bulb shell, and the bottom of the sealing holes is arranged at the inner side of the mouth of the bulb shell, such reverse arrangement can also achieve the technical effect of sealing and waterproofing.

Further, a groove is formed at the outer end face of the rubbery seal seat, the groove is perpendicular to the axis of the sealing holes, and at least part of section areas of the sealing holes overlap with the groove correspondingly.

As a preferred solution, raised strips protruding out of the outer end face of the rubbery seal seat are arranged at both sides of the groove to give an effect more beneficial to structural optimization and assembly efficiency.

Further, the rubbery seal seat comprises a sealing and waterproof cylindrical portion, the upper part of the cylindrical portion is connected with a support portion, and the lower part of the cylindrical portion is provided with a flange.

Further, glue is applied between the lamp holder and the outer side of the mouth of the bulb shell, the lamp holder is in threaded connection with the bulb shell and an air gap is reserved.

Further, the first extension wire comprises a first wire and a second wire, and the diameter of the second wire is larger than that of the first wire; the second extension wire comprises a third wire and a fourth wire, the diameter of the third wire is larger than that of the fourth wire, and the first resistor and the second resistor are in interference fit with the sealing holes.

Further, a water gap is reserved at the bottom electrode of the lamp holder, and at least one of the sealing holes is a blind hole through which the first extension wire can pass.

Preferably, a jack is arranged at an end face of the rubbery seal seat in the bulb shell, and a plastic column for supporting the light bar is arranged in the jack.

Advantageous effects: Compared with the prior art, the waterproof bulb structure provided by the present invention comprises a lamp holder and a bulb shell matched with the lamp holder, and further comprises a core column assembly and a rubbery seal seat with an elastic waterproof seal. The present invention has the following advantages: resistors are fixed at the rubbery seal seat, with wires passing through sealing holes, and the first conductive component and the second conductive component are in fit with the sealing holes to prevent water or moisture from entering the bulb shell, so that water can be completely prevented from entering the bulb shell, and the lamp does not produce fogging when in use, and has good lighting effect and longer service life.

Figure 1:
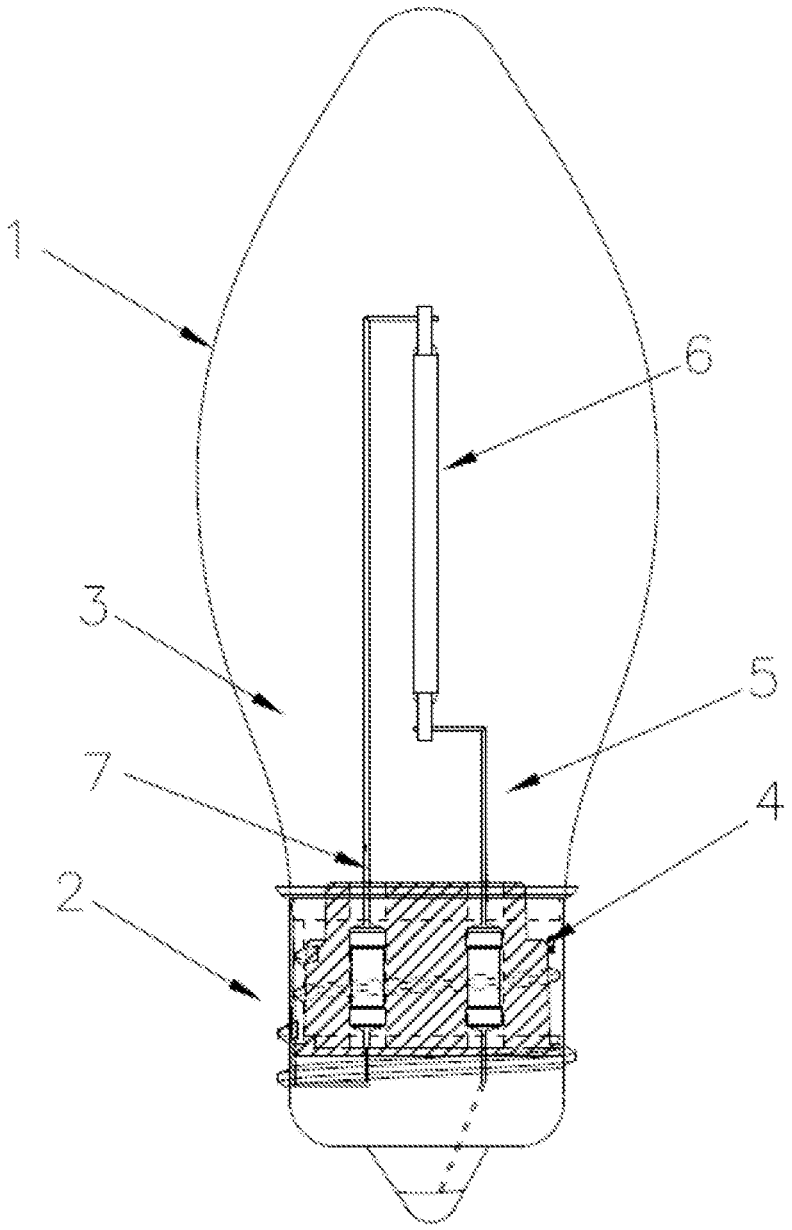
FIG. 1 is a structural diagram of a bulb of the present invention.

Bulb shell—1, lamp holder—2, core column assembly—3, rubbery seal seat—4, sealing holes—41, groove—42, raised strip—43, cylindrical portion—44, support portion—45, flange—46, first conductive component—5, resistor a—51, first wire—52, second wire—53, LED light bar—6, second conductive component—7, resistor b—71, third wire—72, fourth wire—73, plastic column—8.

DESCRIPTION OF THE INVENTION

The present invention will be described in detail with reference to FIGS. 1 to 7.

Disclosed by the present invention is a waterproof bulb structure, comprising a bulb shell 1 and a lamp holder 2 connected with the bulb shell 1, and further comprising a core column assembly 3 and a rubbery seal seat 4 with an elastic waterproof seal; wherein the core column assembly 3 comprises a first conductive component 5, an LED light bar 6 and a second conductive component 7 that are electrically connected in sequence; wherein the first conductive component 5 comprises a resistor a51, and both ends of the resistor a51 are connected with an extension wire a; both ends of the second conductive component 7 are connected with an extension wire b; the middle part of the second conductive component 7 can be a reverse extension of the extension wire b, the rubbery seal seat 4 is provided with sealing holes 41 for accommodating the resistor a51, the resistor a51 is in close fit in the sealing holes 41, and any extension wire a and extension wire b pass through the sealing holes 41 respectively; wherein an extension wire a is electrically connected to one electrode of the lamp holder 2 as an input terminal, and an extension wire b is electrically connected to the other electrode of the lamp holder 2 as an output terminal.

The rubbery seal seat 4 is mainly used for fixing the resistor a51, and wires pass through the sealing holes 41 through one-time puncture, by which the resistor is in fit with the sealing holes 41 to prevent water from entering in most circumstances, and completely prevent water from entering the bulb shell 1 under the puncture effect at the bottom of the sealing hole 41, so that the lamp does not produce fogging when in use and has a longer service life.

As another option, compared with the single resistor in the previous solution, double resistors can be used in the present solution. The second conductive component 7 comprises a resistor b71, and both ends of the resistor b71 are connected with an extension wire b. It is common to use the same wire diameter for the extension wires a and b, which will not affect the water resistance, but it is generally recommended to use metal wires with certain rigidity for the extension wires a and b in the present solution.

The rubbery seal seat 4 is in close fit with the inner side of a mouth of the bulb shell 1, and the lamp holder 2 is fixedly connected with the outer side of the mouth of the bulb shell 1.

Figure 2:
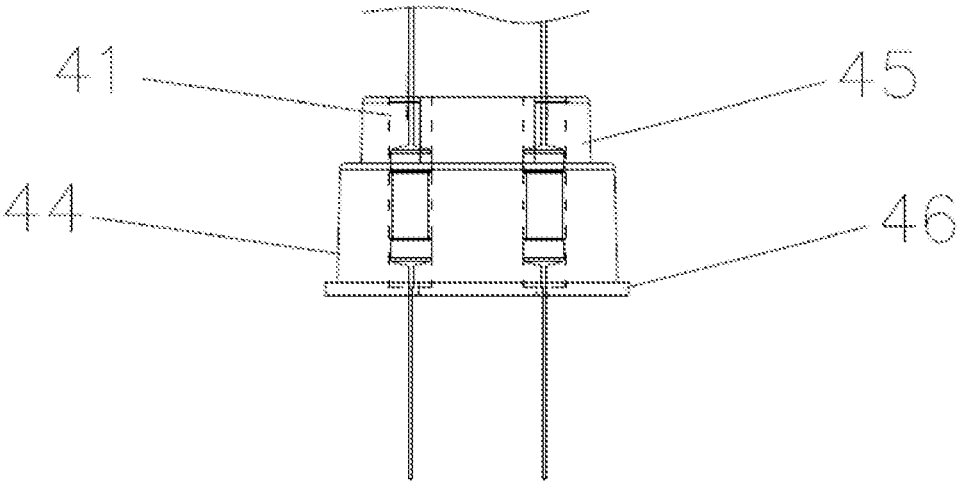
FIG. 2 is a structural diagram of an embodiment with a built-in resistor.
Figure 3:
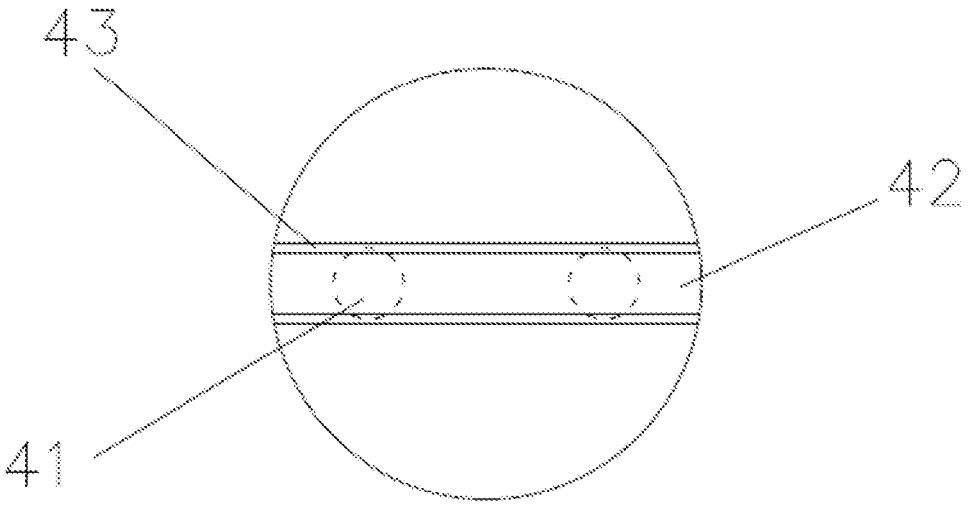
FIG. 3 is a structural diagram of the outer end face of a rubbery seal seat with a built-in resistor.

Referring to FIGS. 2 and 3, as an embodiment of the sealing holes 41, open ends of the sealing holes 41 are arranged at the inner side of the mouth of the bulb shell 1, and the bottom of the sealing holes 41 is arranged at the outer side of the mouth of the bulb shell 1, which can achieve the technical effect of sealing and waterproofing.

Obviously, the function of the sealing holes 41 is very important for the present invention. When the resistor a51 and the resistor b71 are in close fit in the sealing holes 41, the extension wires of the resistors are electrically connected after puncturing the sealing holes 41 respectively. The extension wire a comprises a first wire 52 and a second wire 53; the extension wire b comprises a third wire 72 and a fourth wire 73, and the resistor a51 and the resistor b52 are in interference fit with the sealing holes 41. The first wire 52 and the fourth wire 73 can puncture easily due to the elasticity of the rubber seal base 4 during assembly, and a thickness of 1-2 mm is generally reserved at the bottom of the sealing holes 41. After puncturing, the first wire 52 and the fourth wire 73 can still form end seals due to the elasticity of the rubber seal base 4. It should be emphasized that even if some individual end seals fail, the resistor a51, the resistor b71 and the sealing holes 41 can seal against water or water vapor in a structure in which the resistor a51 and the resistor b71 are in close fit in the sealing holes 41, thereby preventing water or water vapor from entering the bulb shell 1. According to the present invention, the first wire 52 is electrically connected to one electrode (usually a positive electrode) of the lamp holder 2, and the fourth wire 73 is electrically connected to the other electrode (usually a negative electrode) of the lamp holder 2.

Figure 4:
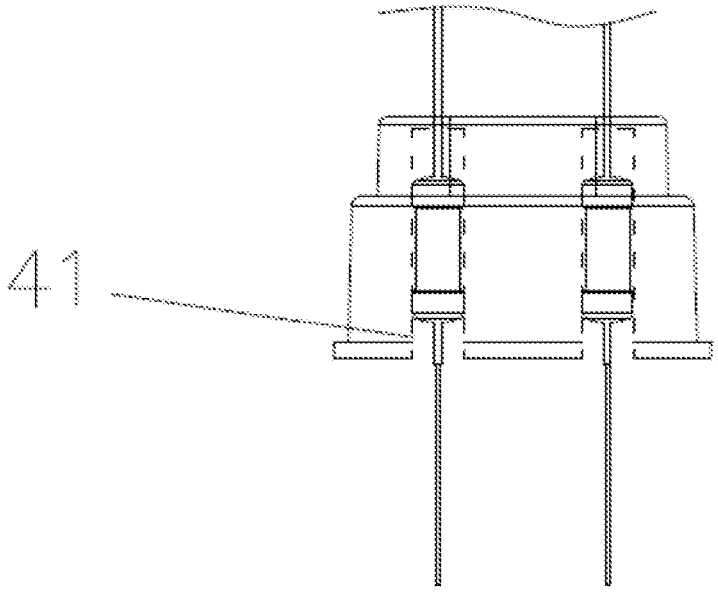
FIG. 4 is a structural diagram of an embodiment with an external resistor.
Figure 5:
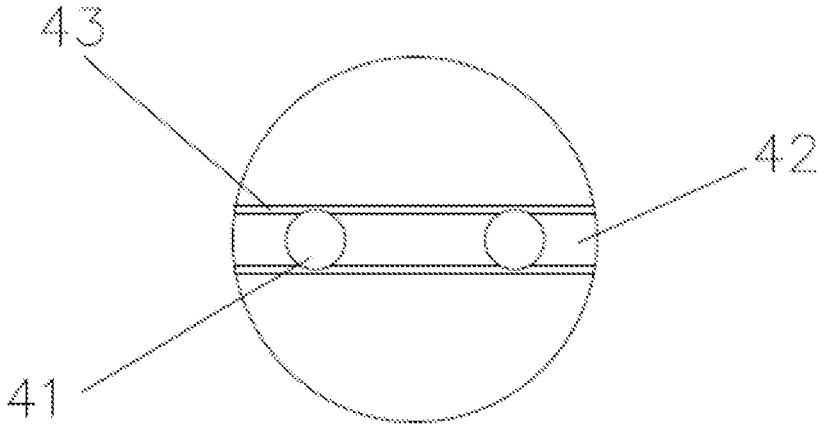
FIG. 5 is a structural diagram of the outer end face of a rubbery seal seat with an external resistor.
Figure 6:
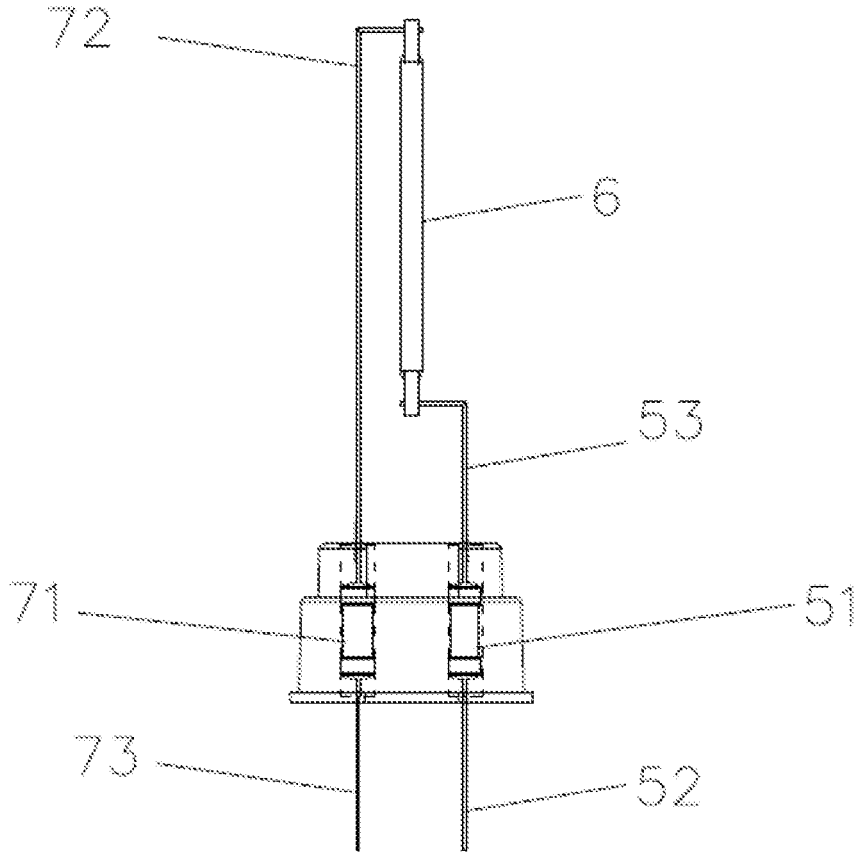
FIG. 6 is a schematic diagram of the internal structure.

Referring to FIGS. 4 and 5, as another embodiment of the sealing holes 41, the open ends of the sealing holes 41 are arranged at the outer side of the mouth of the bulb shell 1, and the bottom of the sealing holes 41 is arranged at the inner side of the mouth of the bulb shell 1, such reverse arrangement can also achieve the technical effect of sealing and waterproofing. The difference between the present embodiment and the previous embodiment is that the direction of the sealing holes 41 in the present embodiment is exactly opposite to that in the previous embodiment. Such structure also has the advantages that: since the open ends of the sealing holes 41 are arranged at the outer side of the mouth of the bulb shell 1, the installed resistor also corresponds to the inner side of the lamp holder 2, and a small amount of water will inevitably enter the lamp holder 2, and the resistor will generate a certain amount of heat when working, thus raising the temperature inside the lamp holder 2 and improving the effect of discharge and moisture removal.

In general, there are also some lamps with smaller diameters, and the size of the corresponding rubbery seal seat 4 is necessarily smaller, but it is still necessary to form a sealing hole 41 on the limited end face space to install a resistor. In the present solution, a groove 42 is formed at the outer end face of the rubbery seal seat 4, the groove 42 is perpendicular to the axis of the sealing holes 41, and at least part of section areas of the sealing holes overlap with the groove 42 correspondingly. The groove 42 has the technical advantages: 1. increasing the structural thickness of the end face when sealing holes 41 are distributed to form an inner space; 2. facilitating the positioning of a circumference during automatic assembly of resistors; and 3. facilitating the restriction of one of the extension wires a or b from being led out along the outer end of the groove 42 so as to avoid approaching to or contacting with another extension wire during spiral assembly.

As a preferred solution, raised strips 43 protruding out of the outer end face of the rubbery seal seat 4 are arranged at both sides of the groove 42, and the protruding height is recommended to be 1-2 mm by actual tests, of course, the protruding height can also increase with the increase of the lamp diameter to give an effect more beneficial to structural optimization and assembly efficiency.

Specifically, the rubbery seal seat 4 comprises a sealing and waterproof cylindrical portion 44, the upper part of the cylindrical portion 44 is connected with a support portion 45, and the lower part of the cylindrical portion 44 is provided with a flange 46. The cylindrical portion 44 is sealed to the mouth of the bulb shell 1, and the flange 46 is used to cover the mouth of the bulb shell 1 to strengthen the sealability.

In order to improve the convenience of assembly, symmetrical assembly planes are arranged on both sides of the support portion 45, so that the sectional area of the support portion 45 can be greatly reduced, which is beneficial to quickly realize positioning and assembly.

In the technical solution, glue is applied between the lamp holder 2 and the outer side of the mouth of the bulb shell 1 to strengthen the connection and fixation between the lamp holder 2 and the bulb shell 1. In order to enable water in the lamp holder 2 caused by the use environment to be discharged, the lamp holder 2 is in threaded connection with the bulb shell 1 and an air gap is reserved. When the lamp is in use, heat from the lamp will evaporate water in the lamp holder, thus keeping the interior of the lamp holder dry and reducing water accumulation.

Since the extension wires are used for support in the present invention, the diameter of the second wire 53 is larger than that of the first wire 52, and the diameter of the third wire 73 is larger than that of the fourth wire 74 to improve the support effects, so that wire consumables of resistors can be saved to the maximum extent and the cost can be reduced while ensuring the supportability.

In the technical solution, the resistor a51 and the resistor b71 are in interference fit with the sealing holes 41. Such interference fit can also provide a sealing effect similar to that of a close fit, and the rubbery seal seat 4 is made of silica gel or rubber.

A water gap is reserved at the bottom electrode of the lamp holder 2 to further increase the evaporation or discharge of water in the lamp holder 2, and at least one of the sealing holes 41 is a blind hole through which the extension wire a can pass. When the rubbery seal seat 4 is mainly used for fixing the resistor a51 or the resistor b, wires pass through the sealing holes 41 through one-time puncture as a blind hole structure is used, thus forming a second layer waterproof structure. Although the resistor is in fit with the sealing holes 41 to prevent water from entering in most circumstances, in the present solution, water can be better prevented from entering the bulb shell 1 under the puncture effect at the bottom of the sealing hole 41, thus achieving the optimal sealing effect.

Figure 7:
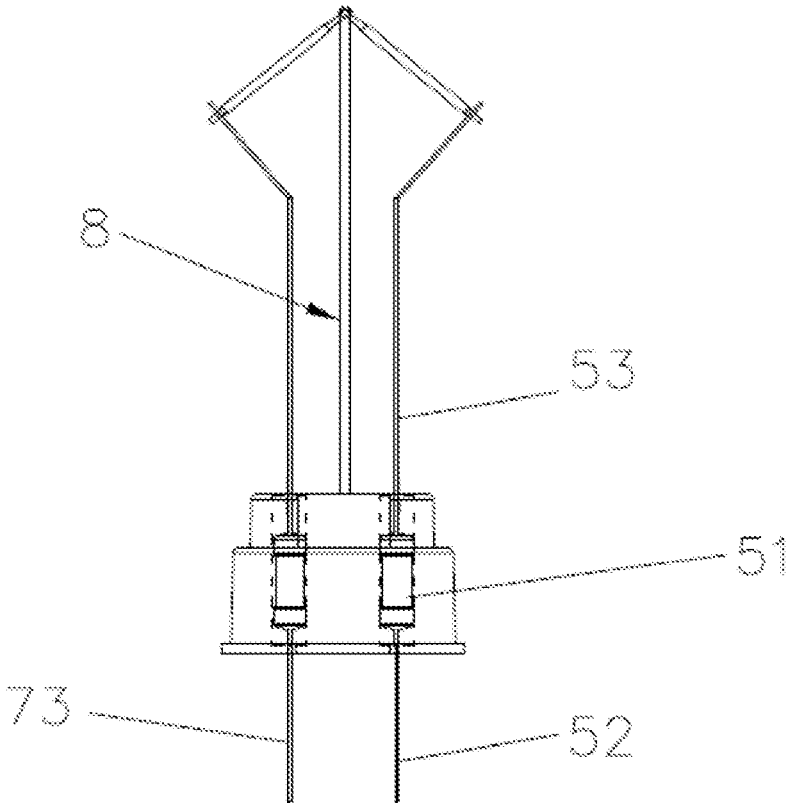
FIG. 7 is a structural diagram of a plurality of LED light bars.

A jack is arranged at an end face of the rubbery seal seat 4 in the bulb shell 1, and a plastic column 8 for supporting the light bar is arranged in the jack. As shown in FIG. 7, when the bulb shell 1 of the lamp is made of a falling-resistant material, the plastic column 8 is used to allow the inner column to have falling-resistant performance.

The above contents are only preferred embodiments of the present invention. For those of ordinary skill in the art, there will be changes in specific embodiments and application scope according to the idea of the present invention, the contents of the specification should not be construed as a limitation to the present invention.

The invention claimed is:

1. A waterproof bulb structure, comprising a bulb shell, a lamp holder connected with the bulb shell, a core column assembly, and a rubbery seal seat with an elastic waterproof seal; wherein the core column assembly comprises a first conductive component, an LED light bar and a second conductive component that are electrically connected in sequence;

wherein the first conductive component comprises a first resistor, and both ends of the first resistor are connected with a first extension wire;

both ends of the second conductive component are connected with a second extension wire;

the rubbery seal seat is provided with at least two sealing holes for accommodating the first conductive component and the second conductive component, and the first extension wire and the second extension wire pass through the sealing holes respectively;

wherein the first extension wire is electrically connected to the lamp holder as an input terminal, and the second extension wire is electrically connected to the lamp holder as an output terminal;

the rubbery seal seat is in close fit with the inner side of a mouth of the bulb shell, and the lamp holder is fixedly connected with the outer side of the mouth of the bulb shell;

a groove is formed at the outer end face of the rubbery seal seat, the groove is perpendicular to the axis of the sealing holes, and at least part of section areas of the sealing holes overlap with the groove correspondingly.

2. The waterproof bulb structure according to claim 1, wherein the second conductive component comprises a second resistor, and the second extension wire is connected to an input terminal and an output terminal of the second resistor respectively.

3. The waterproof bulb structure according to claim 2, wherein the first extension wire comprises a first wire and a second wire, and the diameter of the second wire is larger than that of the first wire;

the second extension wire comprises a third wire and a fourth wire, the diameter of the third wire is larger than that of the fourth wire, and the first resistor and the second resistor are in interference fit with the sealing holes.

4. The waterproof bulb structure according to claim 1, wherein open ends of the sealing holes are arranged at the inner side of the mouth of the bulb shell, and the bottom of the sealing holes is arranged at the outer side of the mouth of the bulb shell; or the open ends of the sealing holes are arranged at the outer side of the mouth of the bulb shell, and the bottom of the sealing holes is arranged at the inner side of the mouth of the bulb shell.

5. The waterproof bulb structure according to claim 1, wherein raised strips protruding out of the outer end face of the rubbery seal seat are arranged at both sides of the groove.

6. The waterproof bulb structure according to claim 1, wherein the rubbery seal seat comprises a sealing and waterproof cylindrical portion, the upper part of the cylindrical portion is connected with a support portion, and the lower part of the cylindrical portion is provided with a flange.

7. The waterproof bulb structure according to claim 1, wherein glue is applied between the lamp holder and the outer side of the mouth of the bulb shell, the lamp holder is in threaded connection with the bulb shell.

* * * * *